US008560330B2

(12) United States Patent
Gao

(10) Patent No.: US 8,560,330 B2
(45) Date of Patent: Oct. 15, 2013

(54) ENERGY ENVELOPE PERCEPTUAL CORRECTION FOR HIGH BAND CODING

(75) Inventor: Yang Gao, Mission Viejo, CA (US)

(73) Assignee: Futurewei Technologies, Inc., Plano, TX (US)

( * ) Notice: Subject to any disclaimer, the term of this patent is extended or adjusted under 35 U.S.C. 154(b) by 303 days.

(21) Appl. No.: 13/185,906

(22) Filed: Jul. 19, 2011

(65) Prior Publication Data

US 2012/0016668 A1 Jan. 19, 2012

Related U.S. Application Data

(60) Provisional application No. 61/365,462, filed on Jul. 19, 2010.

(51) Int. Cl.
*G10L 19/00* (2013.01)
*G10L 21/00* (2013.01)

(52) U.S. Cl.
USPC ..... 704/501; 704/208; 704/224

(58) Field of Classification Search
None
See application file for complete search history.

(56) References Cited

U.S. PATENT DOCUMENTS

| | | | | |
|---|---|---|---|---|
| 7,379,866 | B2 | 5/2008 | Gao | |
| 7,555,434 | B2 * | 6/2009 | Nomura et al. | 704/500 |
| 7,668,711 | B2 * | 2/2010 | Chong et al. | 704/219 |
| 8,036,880 | B2 * | 10/2011 | Liljeryd et al. | 704/200.1 |
| 8,073,687 | B2 * | 12/2011 | Suzuki et al. | 704/220 |
| 8,082,156 | B2 * | 12/2011 | Shimada | 704/500 |
| 8,086,452 | B2 * | 12/2011 | Yoshida | 704/227 |
| 8,244,524 | B2 * | 8/2012 | Shirakawa et al. | 704/205 |
| 8,265,940 | B2 * | 9/2012 | Geiser et al. | 704/500 |
| 8,296,157 | B2 * | 10/2012 | Lee et al. | 704/500 |
| 8,321,229 | B2 * | 11/2012 | Choo et al. | 704/500 |
| 8,401,862 | B2 * | 3/2013 | Nagel et al. | 704/500 |
| 8,417,532 | B2 * | 4/2013 | Schnell et al. | 704/501 |
| 8,433,565 | B2 * | 4/2013 | Lee et al. | 704/229 |
| 8,433,582 | B2 * | 4/2013 | Ramabadran et al. | 704/500 |
| 2005/0065792 | A1 | 3/2005 | Gao | |
| 2008/0195383 | A1 | 8/2008 | Shlomot et al. | |
| 2010/0063802 | A1 | 3/2010 | Gao | |
| 2010/0063803 | A1 | 3/2010 | Gao | |
| 2010/0063806 | A1 | 3/2010 | Gao | |
| 2010/0063808 | A1 | 3/2010 | Gao | |
| 2010/0063810 | A1 | 3/2010 | Gao | |
| 2010/0063811 | A1 | 3/2010 | Gao | |

(Continued)

OTHER PUBLICATIONS

"Discussion and Link Level Simulation Results on LTE-A Downlink Multi-site MIMO Cooperation," 3GPP TSG-Ran Working Group 1 Meeting #55, Nov. 10-14, 2008, pp. 1-11, R1-084465, Nortel, Prague, Czech Republic.

(Continued)

*Primary Examiner* — Brian Albertalli
(74) *Attorney, Agent, or Firm* — Slater & Matsil, L.L.P.

(57) ABSTRACT

In accordance with an embodiment, A method of encoding an audio bitstream at an encoder includes encoding an original low band signal at the encoder by using a closed loop analysis-by-synthesis approach to obtain a coded low band signal, encoding an original high band signal at the encoder by using an open loop energy matching approach to obtain coded high band energy envelopes, comparing an energy of the coded low band signal with an energy of a corresponding original low band signal for a subframe, and generating an indication flag that indicates whether an energy envelope perceptual correction is needed for the subframe based on comparing the energy.

34 Claims, 8 Drawing Sheets

(56) References Cited

U.S. PATENT DOCUMENTS

| | | | | |
|---|---|---|---|---|
| 2010/0063812 | A1 | 3/2010 | Gao | |
| 2010/0063827 | A1 | 3/2010 | Gao | |
| 2010/0070269 | A1 | 3/2010 | Gao | |
| 2010/0070270 | A1 | 3/2010 | Gao | |
| 2010/0286805 | A1 | 11/2010 | Gao et al. | |
| 2011/0002266 | A1 | 1/2011 | Gao | |
| 2011/0137659 | A1 * | 6/2011 | Honma et al. | 704/500 |
| 2011/0257984 | A1 | 10/2011 | Virette et al. | |

OTHER PUBLICATIONS

"Analysis of CQI/PMI Feedback for Downlink CoMP," 3GPP TSG RAN WG1 meeting #56, R1-090941, Feb. 9-13, CATT, 4 pages, Athens, Greece.

ISO-IEC JTC1/SC29/WG11, MPEG2010/N11299, 2009, 9 pages, ISO/IEC.

"TP for feedback in support of DL CoMP for LTE-A TR," 3GPP TSG-RAN WG1 #57, May 4-8, 2009, pp. 1-4, R1-092290, Agenda Item 15.2, Qualcomm Europe, San Fransisco, CA.

Chen, J-H., et al., "Adaptive Postfiltering for Quality Enhancement of Coded Speech," IEEE Transactions on Speech and Audio Processing, Jan. 1995, vol. 3, No. 1, 13 pages.

Ekstrand, P., "Bandwidth Extension of Audio Signals by Spectral Band Replication," Proc. 151 IEEE Benelux Workshop on Model based Processing and Coding of Audio (MPCA-2002), Nov. 15, 2002, 6 pages, Leuven, Belgium.

Dietz, M., et al., "Spectral Band Replication, a novel approach in audio coding," Audio Engineering Society, Convention Paper 5553, May 10-13, 2002, 112$^{th}$ Convention, 8 pages, Munich, Germany.

* cited by examiner

Filter Bank Encoder with SBR or BWE Side Information

Filter Bank Decoder with SBR or BWE and Energy Envelope Perceptual Correction and Optional Post-Processing Encoder with SBR or BWE Side Information Decoder with Filter Bank Analysis-Synthesis, SBR or BWE and Energy Envelope Perceptual Correction and Optional Post-processing

ENERGY ENVELOPE PERCEPTUAL CORRECTION FOR HIGH BAND CODING

This patent application claims priority to U.S. Provisional Application No. 61/365,462 filed on Jul. 19, 2010, entitled "Energy Envelope Perceptual Correction for Bandwidth Extension," which application is incorporated by reference herein in its entirety.

TECHNICAL FIELD

The present invention relates generally to audio/speech processing, and more particularly to energy envelope perceptual correction for high band coding.

BACKGROUND

In modern audio/speech digital signal communication systems, a digital signal is compressed at an encoder, and the compressed information or bitstream can be packetized and sent to a decoder frame by frame through a communication channel. The system of both encoder and decoder together is called codec. Speech/audio compression may be used to reduce the number of bits that represent speech/audio signal thereby reducing the bandwidth and/or bit rate needed for transmission. In general, a higher bit rate will result in higher audio quality, while a lower bit rate will result in lower audio quality.

Audio coding based on filter bank technology is widely used. In signal processing, a filter bank is an array of bandpass filters that separates the input signal into multiple components, each one carrying a single frequency subband of the original input signal. The process of decomposition performed by the filter bank is called analysis, and the output of filter bank analysis is referred to as a subband signal having as many subbands as there are filters in the filter bank. The reconstruction process is called filter bank synthesis. In digital signal processing, the term filter bank is also commonly applied to a bank of receivers, which also may down-convert the subbands to a low center frequency that can be re-sampled at a reduced rate. The same synthesized result can sometimes be also achieved by undersampling the bandpass subbands. The output of filter bank analysis may be in a foam of complex coefficients; each complex coefficient having a real element and imaginary element respectively representing a cosine term and a sine term for each subband of filter bank.

(Filter-Bank Analysis and Filter-Bank Synthesis) is one kind of transformation pair that transforms a time domain signal into frequency domain coefficients and inverse-transforms frequency domain coefficients back into a time domain signal. Other popular transformation pairs, such as (FFT and iFFT), (DFT and iDFT), and (MDCT and iMDCT), may be also used in speech/audio coding.

In the application of filter banks for signal compression, some frequencies are perceptually more important than others. After decomposition, perceptually significant frequencies can be coded with a fine resolution, as small differences at these frequencies are perceptually noticeable to warrant using a coding scheme that preserves these differences. On the other hand, less perceptually significant frequencies are not replicated as precisely; therefore, a coarser coding scheme can be used, even though some of the finer details will be lost in the coding. A typical coarser coding scheme may be based on the concept of Bandwidth Extension (BWE), also known High Band Extension (HBE). One recently popular specific BWE or HBE approach is known as Sub Band Replica (SBR) or Spectral Band Replication (SBR). These techniques are similar in that they encode and decode some frequency sub-bands (usually high bands) with little or no bit rate budget, thereby yielding a significantly lower bit rate than a normal encoding/decoding approach. With the SBR technology, a spectral fine structure in high frequency band is copied from low frequency band, and random noise may be added. Next, a spectral envelope of the high frequency band is shaped by using side information transmitted from the encoder to the decoder. A specific SBR technology with several post-processing modules has recently been employed in the international standard named as MPEG4 USAC wherein MPEG means Moving Picture Experts Group and USAC indicates Unified Speech Audio Coding.

In order to have good sound quality at a low bit rate for speech coding, the speech signal in the low frequency band is often encoded and decoded with a popular technology known as Code-Excited Linear Prediction (CELP) or Algebraic Code-Excited Linear Prediction (ACELP). CELP or ACELP is based on an analysis-by-synthesis approach, which minimizes a weighted error in a closed loop. An analysis-by-synthesis approach is also commonly called a closed loop approach. In the frequency domain, the closed loop approach requires a best match between a coded fine spectrum and an original fine spectrum. On the other hand, in the time domain, the closed loop approach requires a best match between a coded signal waveform and an original signal waveform.

The closed loop approach focuses on coding perceptually more important areas, thereby making the quantization noise less audible and increasing the perceptual quality of a coded speech signal. However, an open-loop approach is often used to code a high band signal. The open-loop approach requires an energy matching between a coded signal and an original signal, which is easier than a fine closed loop matching. Therefore, a lower bit rate than the closed-loop approach may be used. If BWE or SBR is used to code a high band signal, the closed loop approach is not used to determine the best parameters of the BWE or SBR. Rather, the open-loop approach is used to calculate the parameters of the BWE or SBR, since there is no way to perform the closed loop approach for the BWE or SBR. This is because the high band fine spectrum is generated at a decoder and it may not match the original high band fine spectrum in detail. The open-loop approach is, therefore, appropriate for the BWE or SBR as it requires an energy match between the original signal and the coded signal.

SUMMARY OF THE INVENTION

In accordance with an embodiment, a method of encoding an audio bitstream at an encoder includes encoding an original low band signal at the encoder by using a closed loop analysis-by-synthesis approach to obtain a coded low band signal, encoding an original high band signal at the encoder by using an open loop energy matching approach to obtain coded high band energy envelopes, comparing an energy of the coded low band signal with an energy of a corresponding original low band signal for a subframe, generating an indication flag that indicates whether an energy envelope perceptual correction is needed for the subframe based on comparing the energy, and electronically transmitting the coded low band signal, the coded high band energy envelopes, and the indication flag.

In accordance with a further embodiment, a method of decoding an encoded audio bitstream at a decoder includes electronically receiving the encoded audio bitstream, where the encoded audio bitstream has a coded low band signal, coded high band energy envelopes, and an indication flag.

The method also includes performing an energy envelope perceptual correction by reducing amplitudes of the coded high band energy envelopes if the indication flag is in a true state, generating a high band signal by applying the coded high band energy envelopes after performing the energy envelope perceptual correction, and forming an output speech/audio signal from the coded low band signal and the generated high band signal.

In accordance with a further embodiment, a method of encoding an audio bitstream at an encoder includes encoding an original low band signal at the encoder by using a closed loop analysis-by-synthesis approach to obtain a coded low band signal, encoding an original high band signal at the encoder by using an open loop energy matching approach to obtain coded high band energy envelopes, comparing an energy of the coded low band signal with an energy of a corresponding original low band signal, and generating an indication flag that indicates whether an energy envelope perceptual correction is needed based on comparing the energy. The method further includes calculating high band energy envelopes of the original high band signal at the encoder, applying energy envelope perceptual correction by reducing amplitudes of the high band energy envelopes if the indication flag is true, encoding the high band energy envelopes after applying the energy envelope perceptual correction at the encoder by using an open loop energy matching to obtain coded high band energy envelopes, electronically transmitting the coded low band signal, and the coded high band energy envelopes.

In accordance with a further embodiment, a system for encoding an audio signal includes a low band encoder configured to encode an original low band signal using a closed loop analysis-by-synthesis approach to obtain a coded low band signal, and a high band encoder configured to encode an original high band signal using an open loop energy matching approach to obtain coded high band energy envelopes. The system also has an energy comparison block configured to compare an energy of the coded low band signal with an energy of a corresponding original low band signal for a subframe, and generate an indication flag to indicate whether an energy envelope perceptual correction is needed for the subframe based on comparing the energy. In an embodiment, an interface block transmits the coded low band signal, the coded high band energy envelopes, and the indication flag.

In accordance with a further embodiment, a system for encoding an audio signal includes a low band encoder configured to encode an original low band signal using a closed loop analysis-by-synthesis approach to obtain a coded low band signal, and a high band encoder configured to encode an original high band signal using an open loop energy matching approach to obtain coded high band energy envelopes. The system also includes an energy comparison block configured to compare an energy of the coded low band signal with an energy of a corresponding original low band signal for a subframe, and generate an indication flag that indicates whether an energy envelope perceptual correction is needed for the subframe based on comparing the energy. In an embodiment, the system also has a correction block that reduces amplitudes of the high band energy envelopes if the indication flag is true, a high band energy envelope encoder configured to encode the high band energy envelopes after applying the energy envelope perceptual correction at the encoder by using an open loop energy matching to obtain coded high band energy envelopes, and an interface block configured to transmit the coded low band signal, and the coded high band energy envelopes.

In accordance with another embodiment, a system for decoding an encoded audio bitstream, the system includes a receiver for receiving an encoded bitstream comprising a coded low band signal, coded high band energy envelopes, and an indication flag. The system also has a perceptual correction block configured to reduce amplitudes of the coded high band energy envelopes to form corrected coded high band energy envelopes if the indication flag is in a true state, a high band signal generator coupled to the perceptual correction block that applies the high band energy envelopes to form a generated high band signal, and a filter bank synthesis block configured to form an output speech/audio signal from the coded low band signal and the generated high band signal.

In accordance with a further embodiment, a non-transitory computer readable medium has an executable program stored thereon that instructs a processor to perform the steps of encoding an original low band signal using a closed loop analysis-by-synthesis approach to obtain a coded low band signal, encoding an original high band signal using an open loop energy matching approach to obtain coded high band energy envelopes, comparing an energy of the coded low band signal with an energy of a corresponding original low band signal for a subframe, generating an indication flag that indicates whether an energy envelope perceptual correction is needed for the subframe based on comparing the energy, and transmitting the coded low band signal, the coded high band energy envelopes, and the indication flag.

The foregoing has outlined rather broadly the features of an embodiment of the present invention in order that the detailed description of the invention that follows may be better understood. Additional features and advantages of embodiments of the invention will be described hereinafter, which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the embodiments, and the advantages thereof, reference is now made to the following descriptions taken in conjunction with the accompanying drawings, in which.

DETAILED DESCRIPTION OF ILLUSTRATIVE EMBODIMENTS

The making and using of the embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to various embodiments in a specific context, a system and method for audio coding and decoding. Embodiments of the invention may also be applied to other types of signal processing.

Embodiments of the present invention use energy envelope perceptual correction to improve the performance of high band coding based on the open-loop approach, such as BWE or SBR techniques. The energy envelope perceptual correction may operate only at an encoder side or may be used as one of the post-processing technologies at a decoder side to further improve a low bit rate coding (such as BWE or SBR) of speech and audio signals. A codec with BWE or SBR technology spends most number of bits for coding low frequency band rather than high frequency band. The basic feature of BWE or SBR is that a fine spectral structure of high frequency band may be generated or simply copied from a low frequency band without spending any bits or by only spending very small number of bits. Energy envelopes of a high band signal, which determine the spectral energy distribution over the high frequency band and/or the signal energy distribution over the time direction, are normally coded with a very limited number of bits. The high frequency band may be roughly divided into several subbands, and an energy for each subband is quantized and sent from the encoder to the decoder, which is updated for each frame of signal or each subframe of signal. The information to be coded with the BWE or SBR for the high frequency band is called side information because the spent number of bits for the high frequency band is much smaller than a normal coding approach or much less significant than the low frequency band coding.

In an embodiment, the need of the energy envelope perceptual correction is detected at an encoder side. However, the actual energy envelope perceptual correction may be performed at either the encoder or the decoder. If the energy envelope perceptual correction is performed at the decoder, a controlling flag is used to control the energy envelope perceptual correction module. Here, information for sending the controlling flag from the encoder to the decoder is viewed as a part of the side information for the BWE or SBR. For example, one bit can be spent to switch on or off the energy envelope perceptual correction module or to choose a different energy envelope perceptual correction module.

Figure 1A:
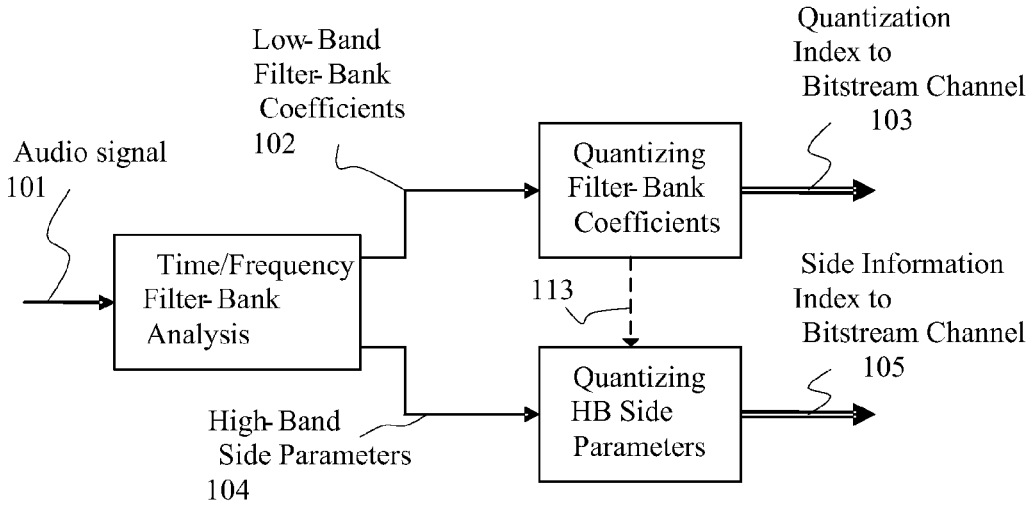
FIGS. 1*a-b* illustrate an embodiment encoder and decoder according to an embodiment of the present invention.
Figure 1B:
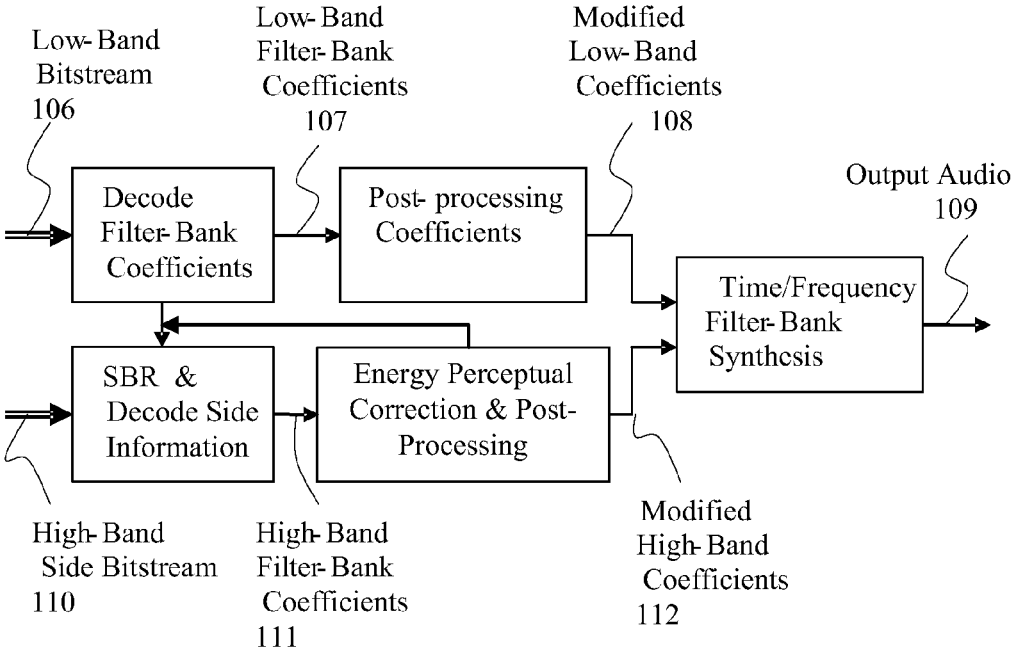

FIG. 1 and FIG. 2 illustrate some typical examples of the encoder/decoder applying a BWE or SBR approach. FIG. 1 and FIG. 2 also show the possible location of the energy envelope perceptual correction application. The exact location of the energy envelope perceptual correction, however, depends on the detailed encoding/decoding scheme as will be further explained. FIG. 3-8 are used to illustrate the performance of embodiment energy envelope perceptual correction systems and methods.

In FIG. 1, an original audio signal or speech signal 101 at the encoder is first transformed into a frequency domain by using filter bank analysis or other transformation approach. Output coefficients 102 of low frequency band from the transformation are quantized and transmitted to a decoder through a bitstream channel 103. Output coefficients 104 of high frequency band from the transformation are analyzed and only low bit rate side information for high frequency band is transmitted to the decoder through a bitstream channel 105. At the decoder, the quantized filter bank coefficients 107 of low frequency band are decoded by using the bitstream 106 from the transmission channel. The low band frequency domain coefficients 107 may be optionally post-processed to get the post-processed coefficients 108, before performing an inverse transformation such as filter bank synthesis. The high band signal is decoded with a BWE or SBR technology, using side information to help the generation of high frequency band.

In an embodiment, the side information is decoded from bitstream 110, and frequency domain high band coefficients 111 or post-processed high band coefficients 112 are generated using several steps. The steps may include at least two basic steps: one step is to copy the low band frequency coefficients to a high band location, and other step is to shape the spectral envelope of the copied high band coefficients by using the received side information. In some embodiment, energy envelope perceptual correction is applied to the high frequency band before or after the spectral envelope is applied. Energy envelope perceptual correction may also be applied at the encoder only rather than the decoder if, for example, no additional bits are available.

Dashed line 113 indicates that the coded low band information is used to detect an indication flag indicating that energy envelope perceptual correction is needed. In an embodiment, if the energy envelope perceptual correction is applied at the decoder, the indication flag is sent to the decoder through the high band side information channel. On the other hand, if the energy envelope perceptual correction is applied at the encoder, the indication flag is used to control the modification of the high band energy envelope quantization. In embodiments, both the high band and low band filter bank coefficients may be optionally post-processed before performing filter bank synthesis.

In embodiments where BWE or SBR coding in the high band are much coarser than the normal coding in the low band, post-processing in the high band may be made stronger while post-processing in the low band may be made weaker. The high band and low band coefficients are finally combined together and inverse-transformed back to the time domain to obtain the output audio signal 109.

Figure 2A:
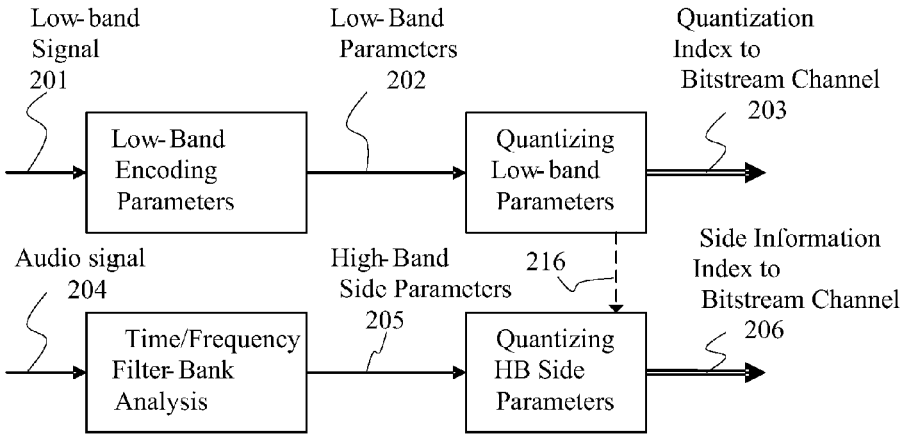
FIGS. 2*a-b* illustrate an embodiment encoder and decoder according to a further embodiment of the present invention.
Figure 2B:
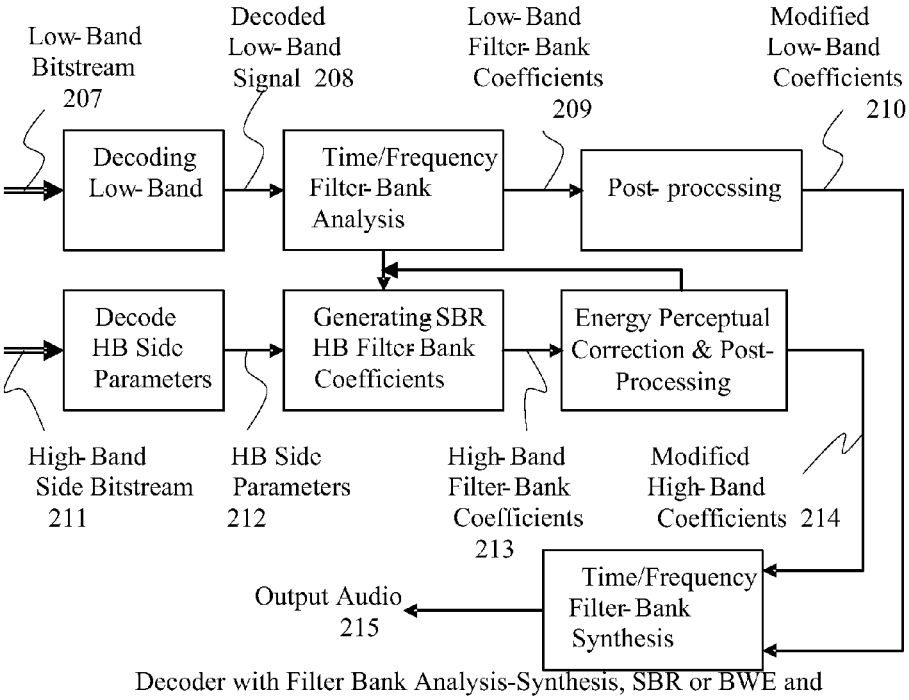

FIGS. 2*a* and 2*b* illustrate an embodiment encoder and decoder, respectively. In an embodiment, a low band signal is encoded/decoded with any coding scheme while a high band is encoded/decoded with a low bit rate BWE or SBR scheme. Normally, the low band signal is coded with a closed-loop approach in order to have a high quality. At the encoder side of FIG. 2*a*, a low band original signal 201 is analyzed by the low band encoder to obtain the low band parameters 202. The low band parameters are then quantized and transmitted from the encoder to the decoder through a bitstream channel 203. In an embodiment, original signal 204 including the high band signal is transformed into a frequency domain by using filter bank analysis or other transformation tool. The output coefficients of high frequency band from the transformation are analyzed to obtain the side parameters 205 which represent the high band side information; only the low bit rate side information for high frequency band is transmitted to the decoder through a bitstream channel 206.

At the decoder side of FIG. 2*b*, the low band signal 208 is decoded with the received bitstream 207. The low band signal is then transformed into a frequency domain by using a transformation tool such as filter bank analysis to obtain the corresponding frequency coefficients 209. These low band frequency domain coefficients 209 may be optionally post-processed to get the post-processed coefficients 210 before going to an inverse transformation such as filter bank synthesis. The high band signal is decoded with a BWE or SBR technology, using side information to help the generation of high frequency band.

In an embodiment, side information is decoded from the bitstream 211 to obtain the side parameters 212. Frequency domain high band coefficients 213 or post-processed high band coefficients 214 are generated using at least two basic steps. One step is to generate the high band coefficients or copy the low band frequency coefficients to the high band location. The other step is to shape the spectral envelope of the high band coefficients by using the side parameters.

In embodiments, energy envelope perceptual correction may be applied to the high frequency band before or after the received spectral envelope is applied. Furthermore, the energy envelope perceptual correction may even be applied at the encoder only if no additional bit is available. Dashed line 216 indicates that the coded low band information is used to detect an indication flag telling if the energy envelope perceptual correction is needed. If the energy envelope perceptual correction is applied at the decoder, the indication flag is sent to the decoder through the high band side information channel. If, however, the energy envelope perceptual correction is applied at the encoder, the indication flag is used to control the modification of the high band energy envelope quantization. Both the high band and low band filter bank coefficients may be optionally post-processed before doing filter bank synthesis.

In some embodiments where BWE or SBR coding in the high band is much coarser than the normal coding in the low band, that post-processing in the high band may be made stronger while post-processing in the low band may be made weaker. The high band and low band coefficients are finally combined together and inverse-transformed back to the time domain to obtain the output audio signal 215.

FIGS. 3-8 illustrate the effect of embodiment systems and methods on the spectral contact of an audio signal. Suppose a low frequency band is encoded/decoded in a normal coding approach and a high frequency band is generated by using a BWE or SBR approach. Normally, the low band signal is coded with a closed-loop approach in order to have a high quality and BWE or SBR techniques are used to code the high band using an open-loop approach.

Figure 3:
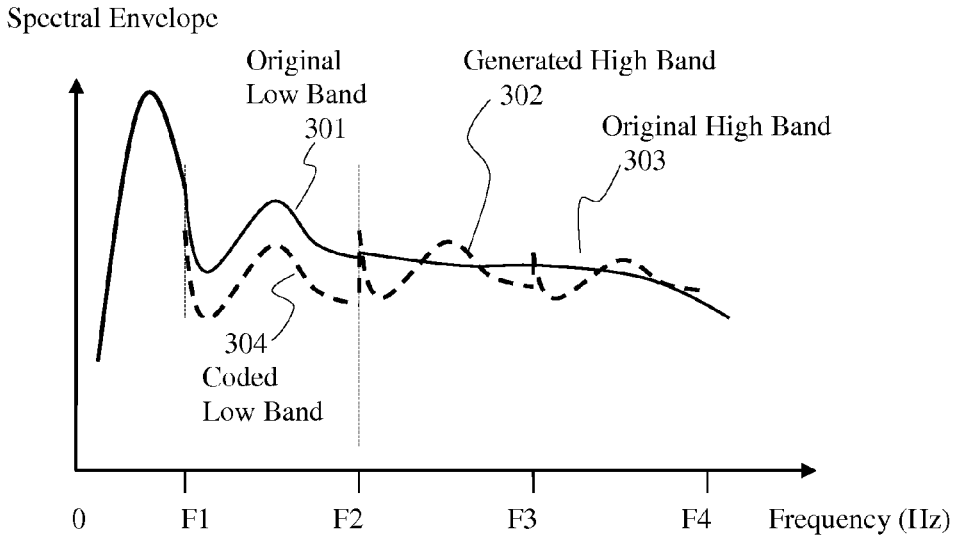
FIG. 3 illustrates a generated high frequency band by using a SBR (or BWE) approach for voiced speech, without perceptual energy correction using embodiment systems and methods.

FIG. 3 illustrates a spectra representing voiced speech. Curve 301 is an original low band spectral envelope and 303 is an original high band spectral envelope, which are available at an encoder. Curve 304 is a coded low band spectral envelope and 302 is a coded high band spectral envelope, which are available at both the encoder and a decoder. When the high band is wider than the low band, it is possible at the decoder that the low band needs to be repeatedly copied to the high band and then scaled. In the example of FIG. 3, [F1, F2] is copied to [F2, F3] and [F3, F4].

In a SBR or BWE algorithm, determining the high band energy envelopes in both frequency direction and time direction is an important step. The quantization resolutions of the high band energy envelopes are often limited due to limited bit rate. In an embodiment, the quantization indices of the high band energy envelopes are determined at the encoder in an open loop approach which tries to find a best energy match between the coded energy envelope and the original energy envelope for each sub-band in frequency domain or for each subframe in time domain. This is because there is no way to perform a closed loop approach as the generated high band can not match the original high band in detail. However, the open loop energy matching approach to quantize the high band energy may not be the best way in perceptual point of view, especially when the low band is coded/quantized in a closed loop way. CELP or ACELP is a popular technology to code speech signal. The popular CELP or ACELP speech coding method employs the typical closed loop approach which minimizes a perceptually weighted error between an original waveform signal and a coded (synthesized) waveform signal through an analysis-by-synthesis.

The closed loop approach can make quantization noise less audible and then increase the perceptual quality, which often results an energy loss in a relatively higher frequency area, as shown in the example of FIG. 3 where the coded spectral envelope 304 is much lower than the original spectral envelope 301. In FIG. 3, the low band is coded with a CELP method which emphasizes a perceptually more important area in the low band so that the energy in [0, F1] is closer to the original, while the energy in [F1, F2] is much lower than the original. The spectrum above F2 is defined as the high band which is generated by copying the low band and maintaining the energy close to the original. When the coded energy in [F1, F2] is much lower than the original, it is perceptually not the best choice to maintain the high band energy close to the original. Instead, it may be perceptually better, in some embodiments, to make the high band energy lower than the original so that the over all spectrum shape is still similar to the original and the coding noise in the high band is less audible.

Figure 4:
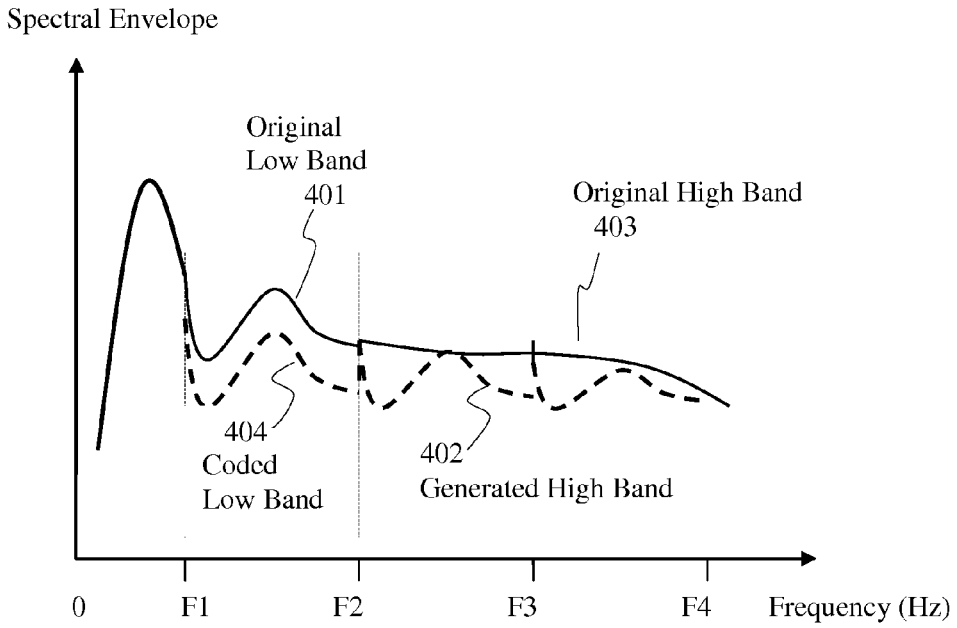
FIG. 4 illustrates a generated high frequency band by using a SBR (or BWE) approach for voiced speech, with perceptual energy correction using embodiment systems and methods.

FIG. 4 shows a modification of FIG. 3, in which the quantized high band energy 402 is made lower than the original 403. If no additional bits are available, the quantized high band energy reduction may be realized by just modifying the quantization of the high band energy at the encoder and sending the quantization indexes representing the lower high band energy envelope 402 to the decoder. Assuming that coded low band envelope 404 is x dB lower than the original low band envelope 401, the same amount of the energy reduction of x dB may be introduced to the quantized high band energy envelope during the quantization process at the encoder, so that the energy envelope perceptual correction is realized at the encoder only.

As the quantization of the high band energy envelope may be rough or imprecise, embodiment energy envelope perceptual correction techniques may be realized at the decoder by sending few additional bits in the side information for coding the high band in some embodiments. For example, if the quantization of the high band energy envelope is updated once for every frame of 20 ms, 1 bit for every subframe of 5 ms can be sent to the decoder to indicate whether energy envelope perceptual correction is needed for the subframe of 5 ms.

Here is an embodiment algorithm example that identifies segments or subframes, which have lower energy in the low band than the original, and then transmits an indication flag for each segment or subframe to the decoder. The following algorithm example is based on FIG. 2. In an embodiment, the following example may be related to MPEG-4 technology. Suppose the unquantized Filter-Bank complex coefficients for a long frame of 2048 output samples (also called super-frame) at the encoder are:

$$\{Sr_enc[i][k], Si_enc[i][k]\},\ i=0,1,2,\ldots,31;\ k=0,1,2,\ldots,63\ldots, \tag{1}$$

where i is the time index which represents 2.22 ms step at the sampling rate of 28800 Hz; k is the frequency index indicating 225 Hz step for 64 small subbands from 0 to 14400 Hz. If Start_HB is the boundary between the high band and the low band, {k=0, . . . , Start_HB−1} indicates the low band and {k=Start_HB, . . . , 63} indicates the high band. The quantized Filter-Bank complex coefficients for a long frame of 2048 output samples at both the encoder and the decoder are noted as:

$$\{Sr_dec[i][k], Si_dec[i][k]\},\ i=0,1,2,\ldots,31;\ k=0,1,2,\ldots,63. \tag{2}$$

For speech signals, the coefficients of (2) in the low band are obtained by transforming the low band time domain signal outputted from an ACELP codec into the frequency domain. The unquantized time-frequency energy array for one super-frame at the encoder can be expressed as:

$$TF_energy_enc[i][k]=(Sr_enc[i][k])^2+(Si_enc[i][k])^2,\ i=0,1,2,\ldots,31;\ k=0,1,\ldots,63. \tag{3}$$

The quantized time-frequency energy array for one super-frame at both the encoder and the decoder is:

$$TF_energy_dec[i][k]=(Sr_dec[i][k])^2+(Si_dec[i][k])^2,\ i=0,1,2,\ldots,31;\ k=0,1,\ldots,63, \tag{4}$$

The average frequency direction energy distribution for one super-frame at the encoder can be noted as:

$$\text{F_energy_enc}[k] = \frac{1}{32}\sum_{i=0}^{31}\text{TF_energy_enc}[i][k],\quad k = 0, 1, \ldots, 63. \tag{5}$$

A parameter used to help indicating voiced speech is an energy ratio which represents the spectrum tilt is:

$$\text{tilt_energy_ratio} = \frac{\text{h_energy}}{\text{l_energy}}; \tag{6}$$

$$\text{l_energy} = \frac{1}{L1}\sum_{k=0}^{L1-1}\text{F_energy_enc}(k); \tag{7}$$

$$\text{h_energy} = \frac{1}{(L3-L2)}\sum_{k=L2}^{L3-1}\text{F_energy_enc}(k), \tag{8}$$

where L1, L2, and L3 are constants; their example values are L1=8, L2=16, and L3=24.

In an embodiment, if there are N_BITS bits used to identify the smaller time domain segments or subframes that contain significantly lower quantized energy in the low band than the original, the super-frame can be divided into N_BITS smaller segments, for each small segment, the detection is performed at the encoder as the following procedure:

```
N = 32/N_BITS ;
for (j = 0, 1, 2, . . . , N_BITS − 1) {
    Initial: tEnv_flag = 0 ;
```

$$\text{energy_orig_LB} = \sum_{i=j\cdot N}^{j\cdot N+N-1}\ \sum_{k=Start_HB/2}^{Start_HB-1}\text{TF_energy_enc[i][k]}\ ;$$

$$\text{energy_dec_LB} = \sum_{i=j\cdot N}^{j\cdot N+N-1}\ \sum_{k=Start_HB/2}^{Start_HB-1}\text{TF_energy_dec[i][k]}\ ;$$

```
    if ((energy_orig_LB>1.5 energy_dec_LB) and (tilt_energy_ratio<1/32))
        tEnv_flag = 1;
    Other Detection Blocks;
    tEnv_Flag is sent to the decoder.
}
```

In the above procedure, Start_HB is the boundary point between the low band and the high band; tEnv_flag=1 means that the high band energy for the corresponding segment should be reduced at the decoder; Other Detection Blocks will be explained below.

In the time direction, the energy envelope perceptual correction may also improve BWE or SBR perceptual quality. Time direction energy envelope quantization is usually updated frame by frame due to limited bit budget. In some embodiments, the frame length could be quite long. Sometimes when the original energy envelope shape is not coincident with the one of the generated high band within one frame, the energy envelope perceptual correction may reduce audible quantization noise.

Figure 5:
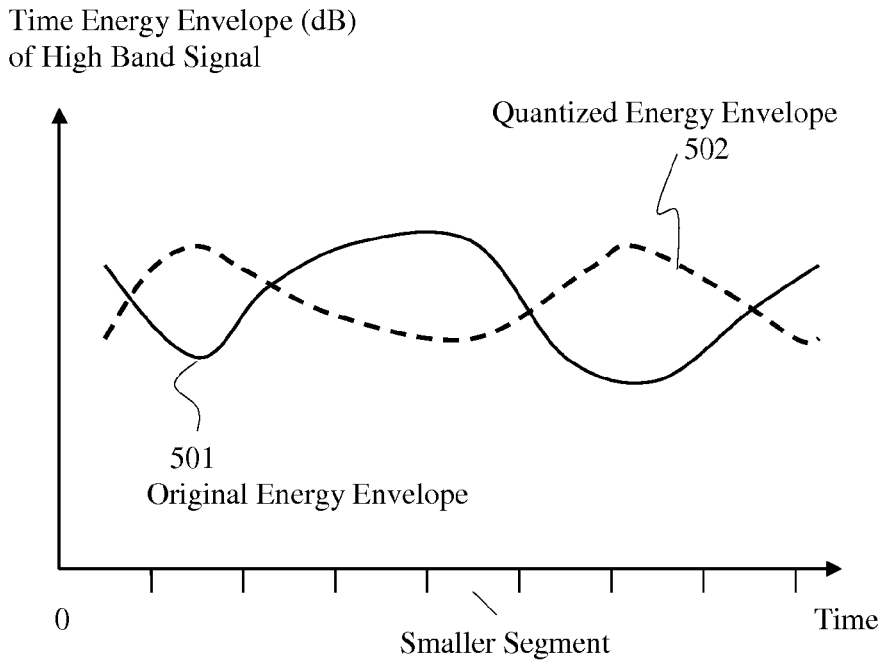
FIG. 5 illustrates one frame of high band signal time domain energy envelope by using a SBR (or BWE) coding approach, without perceptual energy correction using embodiment systems and methods.
Figure 7:
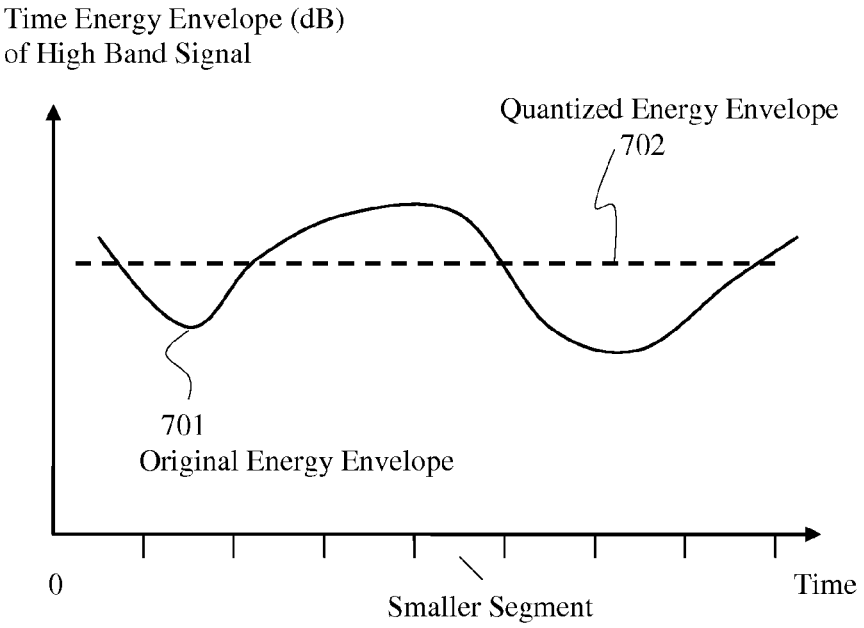
FIG. 7 illustrates one frame of high band signal time domain energy envelope by using a SBR (or BWE) coding approach, without perceptual energy correction using embodiment systems and methods.

FIG. 5 and FIG. 7 provide two examples to illustrate cases where the energy envelope shape of the generated high band is not coincident with the original one within one quantization frame. Curve 501 is the original energy envelope and curve 502 is the quantized energy envelope. Although the frame based energy of the quantized energy envelope 502 is equal to the one of the original energy envelope 501, they have different shapes and different local energies. Similarly, curve 701 is the original energy envelope and 702 is the quantized energy envelope. Although the frame based energy of the quantized energy envelope 702 is equal to the one of the original energy envelope 701, they have different shapes and different local energies.

In the cases of FIG. 5 and FIG. 7, the frame may be further divided into smaller segments, and 1 bit indication flag (tEnv_flag) for each smaller segment is spent to detect if the local quantized energy is too high compared to the original one. In some embodiments, not only may the energy envelope perceptual correction be used to improve the perceptual quality by considering the relative energy variation of the low band signal, but it may also to improve the shape of the quantized high band energy envelope.

Figure 6:
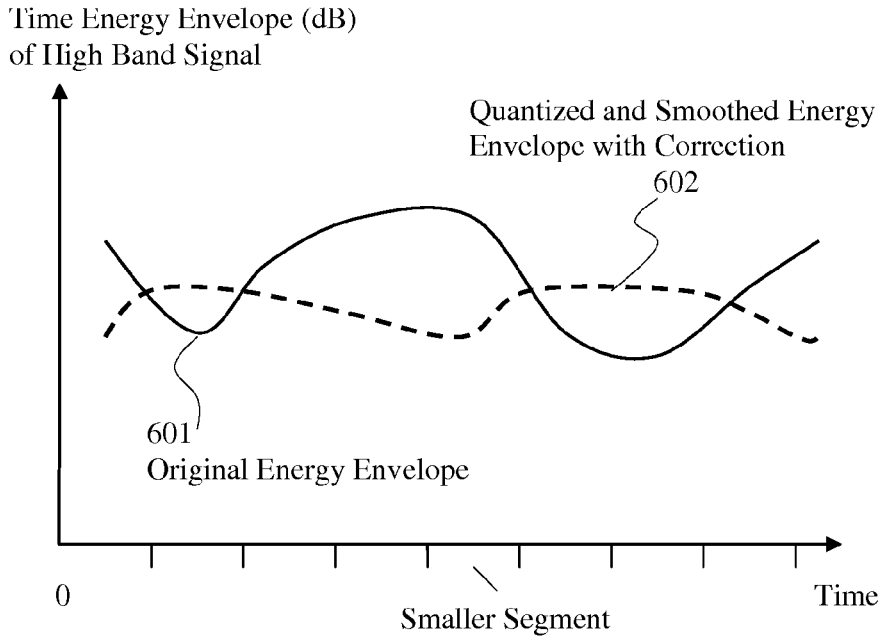
FIG. 6 illustrates one frame of high band signal time domain energy envelope by using a SBR (or BWE) coding approach, with perceptual energy correction using embodiment systems and methods.
Figure 8:
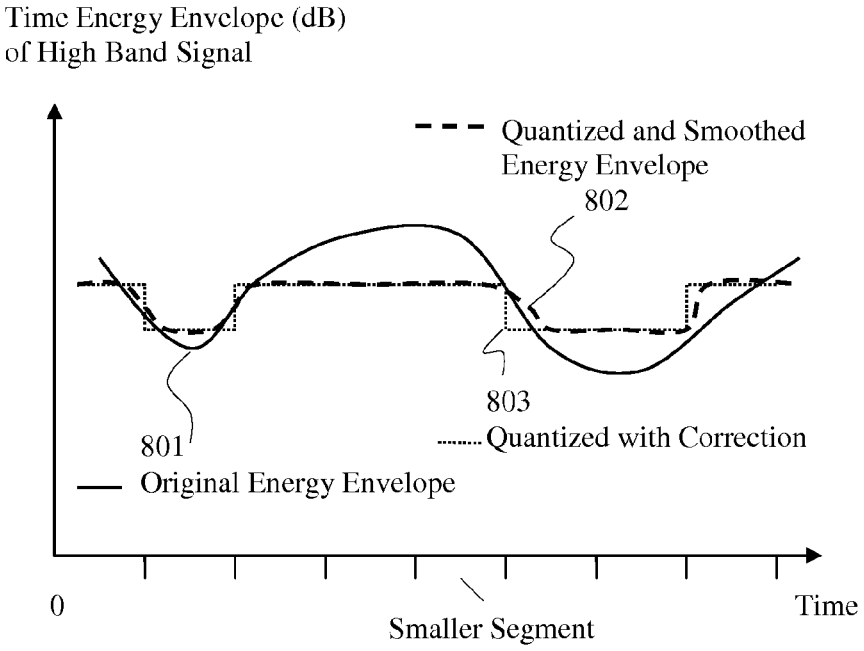
FIG. 8 illustrates one frame of high band signal time domain energy envelope by using a SBR (or BWE) coding approach, with perceptual energy correction using embodiment systems and methods.

FIG. 6 and FIG. 8 show the energy envelope perceptual correction at the decoder by using the received indication flag in order to avoid a local difference between the quantized energy shape and the original one that is too large. Curve 601 is the original energy envelope and curve 602 is the quantized energy envelope after applying the energy envelope perceptual correction. Although the frame based energy of the quantized energy envelope 602 is lower than the one of the original energy envelope 601, the shape of 602 is closer to the one of 601 and the perceptual quality is improved.

Similarly, in FIG. 8, curve 801 is the original energy envelope, and 802 or 803 is the quantized energy envelope after applying the energy envelope perceptual correction. Although the frame based energy of the quantized energy envelope 802 or 803 is lower than the one of the original energy envelope 801, the shape of 802 or 803 is closer to the one of 801 and the perceptual quality is improved.

Another special case is that the quantized energy at one point in the time-frequency energy array is too high compared to the original one at the same point. In embodiments, the energy envelope perceptual correction for this case may also be used to reduce audible quantization noise. The following procedure explains the example detection algorithm at the encoder in detail:

for (j = 0, 1, 2, . . . , N_BITS − 1) {

$$\text{energy_orig_HB} = \sum_{i=j\cdot N}^{j\cdot N+N-1} \sum_{k=Start_HB}^{End_HB-1} \text{TF_energy_enc}[i][k] \;;$$

$$\text{energy_dec_HB} = \sum_{i=j\cdot N}^{j\cdot N+N-1} \sum_{k=Start_HB}^{End_HB-1} \text{TF_energy_dec}[i][k] \;;$$

```
    energy_orig_Max = Max{ TF_energy_enc[i][k],
        i = j · N, . . . , j · N + N−1; k = Start_HB, . . . , End_HB − 1 };
    energy_dec_Max = Max{TF_energy_dec[i][k],
        i = j · N, . . . , j · N + N−1; k = Start_HB, . . . , End_HB − 1 };
    if (tilt_energy_ratio < 1/32) {
      if (energy_dec_HB > 1.5 · energy_orig_HB)
        tEnv_flag = 1;
      if (energy_dec_Max > 2 · energy_orig_Max)
        tEnv_flag = 1;
    }
    tEnv_flag is sent to decoder.
}
```

At the decoder side, embodiment energy envelope perceptual correction is relatively simple. The high band energy is made lower for the segment with which the received flag tEnv_flag=1. The decoded Filter Bank coefficients can be multiplied with a reduction gain factor in the following way:

```
for (j = 0, 1, 2,..., N__BITS − 1) {
    if (tEnv__flag == 1) {
      for (i = j · N ,..., j · N + N − 1; k = Start__HB,...,End__HB − 1) {
          Sr__dec[i][k] ⇐ Sr__dec[i][k] · 0.85 ;
          Si__dec[i][k] ⇐ Si__dec[i][k] · 0.85 ;
      }
    }
}
```

where Start_HB, End_HB, N_BITS and N are constants, which have the same values as in the encoder. In an embodiment, example values are Start_HB=30, End_HB=64, N_BITS=8 and N=4. Alternatively, other values may be used.

In an embodiment, all filter bank coefficients with or without the energy envelope perceptual correction are input to a filter bank synthesis, and a final audio/speech signal is outputted from the filter bank synthesis.

In some embodiments, an energy envelope perceptual correction method for a speech/audio coding system is used to produce a coded speech/audio signal and improve the perceptual quality of a generated high band signal is proposed. Suppose that an original low band signal or original low band frequency coefficients are encoded at an encoder by using an analysis-by-synthesis approach (closed loop approach) to obtain a coded low band signal or coded low band frequency coefficients. High band energy envelopes of an original high band signal or original high band frequency coefficients are encoded at the encoder by using an energy matching approach (open loop approach) to obtain coded high band energy envelopes.

A speech/audio frame is divided into a plurality of subframes, and a comparison between an energy (for example, energy_dec_LB or energy_dec_Max) of the coded low band signal or the coded low band frequency coefficients and an energy (for example, energy_orig_LB energy_orig_Max) of the corresponding original low band signal or the original low band frequency coefficients is made for each subframe, in order to detect an indication flag (tEnv_flag) which indicates whether an energy envelope perceptual correction is needed for each subframe.

In an embodiment, at a decoder side, the energy envelope perceptual correction is performed by reducing the coded high band energy envelopes corresponding to the subframe with the indication flag being true. A high band signal or high band frequency coefficients are generated by applying the coded high band energy envelopes after performing the energy envelope perceptual correction. In some embodiments, the energy envelope perceptual correction can also be performed by multiplying a gain factor (smaller than 1) to the generated high band signal or high band frequency coefficients for the subframe with the indication flag being true.

In other embodiments, an energy envelope perceptual correction is applied only at an encoder side for a speech/audio coding system of producing a coded speech/audio signal and improving perceptual quality of a generated high band signal. Suppose that an original low band signal or original low band frequency coefficients are encoded at the encoder by using an analysis-by-synthesis approach (closed loop approach) to obtain a coded low band signal or coded low band frequency coefficients; a comparison between an energy (for example, energy_dec_LB or energy_dec_Max) of the coded low band signal or the coded low band frequency coefficients and an energy (for example, energy_orig_LB or energy_orig_Max) of the corresponding original low band signal, or the original low band frequency coefficients is made in order to detect an indication flag (tEnv_flag) which indicates if an energy envelope perceptual correction is needed. High band energy envelopes of an original high band signal or original high band frequency coefficients are calculated at the encoder. Next, the energy envelope perceptual correction is applied by reducing the high band energy envelopes if the indication flag is true at the encoder. The high band energy envelopes after applying the energy envelope perceptual correction are encoded at the encoder by using an energy matching approach (open loop approach) to obtain coded high band energy envelopes, and the coded high band energy envelopes are sent from the encoder to a decoder through a bitstream channel. In an embodiment, at the decoder, a high band signal or high band frequency coefficients are generated by applying the coded high band energy envelopes.

Figure 9:
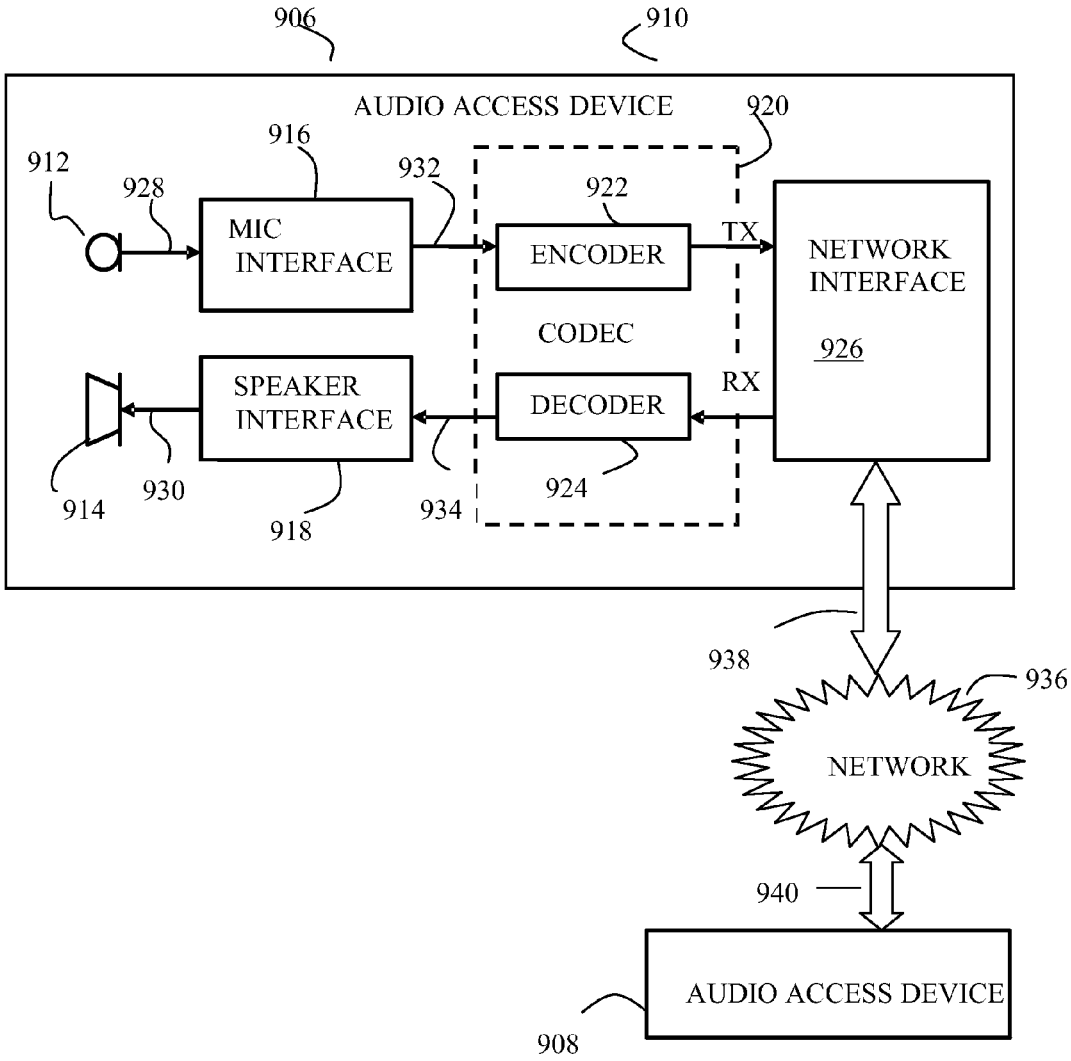
FIG. 9 illustrates a communication system according to an embodiment of the present invention.

FIG. 9 illustrates a communication system 910 according to an embodiment of the present invention. Communication system 910 has audio access devices 906 and 908 coupled to network 936 via communication links 938 and 940. In one embodiment, audio access device 906 and 908 are voice over internet protocol (VOIP) devices and network 936 is a wide area network (WAN), public switched telephone network (PSTN) and/or the internet. In another embodiment, audio access device 6 is a receiving audio device and audio access device 908 is a transmitting audio device that transmits broadcast quality, high fidelity audio data, streaming audio data, and/or audio that accompanies video programming. Communication links 938 and 940 are wireline and/or wireless broadband connections. In an alternative embodiment, audio access devices 906 and 908 are cellular or mobile telephones, links 938 and 940 are wireless mobile telephone channels and network 936 represents a mobile telephone network. Audio access device 906 uses microphone 912 to convert sound, such as music or a person's voice into analog audio input signal 928. Microphone interface 916 converts analog audio input signal 928 into digital audio signal 932 for input into encoder 922 of CODEC 920. Encoder 922 produces encoded audio signal TX for transmission to network 926 via network interface 926 according to embodiments of the present invention. Decoder 924 within CODEC 920 receives encoded audio signal RX from network 936 via network interface 926, and converts encoded audio signal RX into digital audio signal 934. Speaker interface 918 converts digital audio signal 934 into audio signal 930 suitable for driving loudspeaker 914.

In embodiments of the present invention, where audio access device 906 is a VOIP device, some or all of the components within audio access device 906 can be implemented within a handset. In some embodiments, however, Microphone 912 and loudspeaker 914 are separate units, and microphone interface 916, speaker interface 918, CODEC 920 and network interface 926 are implemented within a personal computer. CODEC 920 can be implemented in either software running on a computer or a dedicated processor, or by dedicated hardware, for example, on an application specific integrated circuit (ASIC). Microphone interface 916 is implemented by an analog-to-digital (A/D) converter, as well as other interface circuitry located within the handset and/or within the computer. Likewise, speaker interface 918 is implemented by a digital-to-analog converter and other interface circuitry located within the handset and/or within the computer. In further embodiments, audio access device 906 can be implemented and partitioned in other ways known in the art.

In embodiments of the present invention where audio access device 906 is a cellular or mobile telephone, the elements within audio access device 6 are implemented within a cellular handset. CODEC 920 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 922 or decoder 924, for example, in a digital microphone system or music playback device. In other embodiments of the present invention, CODEC 920 can be used without microphone 912 and speaker 914, for example, in cellular base stations that access the PSTN.

Figure 10:
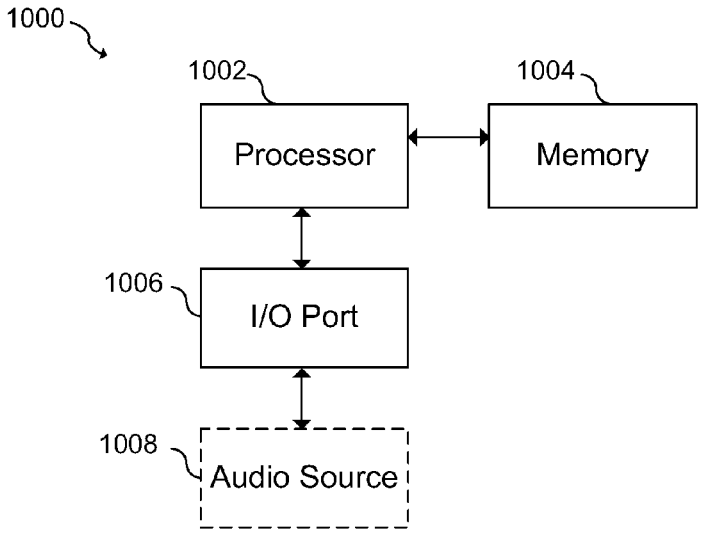
FIG. 10 illustrates a processing system that can be utilized to implement methods of the present invention.

FIG. 10 illustrates a processing system 1000 that can be utilized to implement methods of the present invention. In this case, the main processing is performed in processor 1002, which can be a microprocessor, digital signal processor or any other appropriate processing device. In some embodiments, processor 1002 can be implemented using multiple processors. Program code (e.g., the code implementing the algorithms disclosed above) and data can be stored in memory 1004. Memory 1004 can be local memory such as DRAM or mass storage such as a hard drive, optical drive or other storage (which may be local or remote). While the memory is illustrated functionally with a single block, it is understood that one or more hardware blocks can be used to implement this function.

In one embodiment, processor 1002 can be used to implement various ones (or all) of the units shown in FIGS. 1*a-b* and 2*a-b*. For example, the processor can serve as a specific functional unit at different times to implement the subtasks involved in performing the techniques of the present invention. Alternatively, different hardware blocks (e.g., the same as or different than the processor) can be used to perform different functions. In other embodiments, some subtasks are performed by processor 1002 while others are performed using a separate circuitry.

FIG. 10 also illustrates an I/O port 1006, which can be used to provide the audio and/or bitstream data to and from the processor. Audio source 1008 (the destination is not explicitly shown) is illustrated in dashed lines to indicate that it is not necessary part of the system. For example, the source can be linked to the system by a network such as the Internet or by local interfaces (e.g., a USB or LAN interface).

Figure 11:
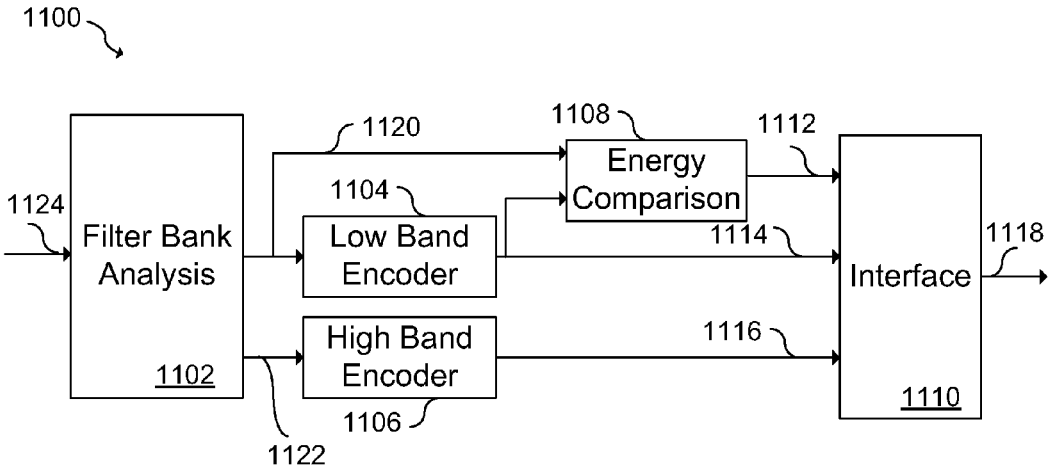
FIG. 11 illustrates a block diagram of an embodiment encoder.

FIG. 11 illustrates embodiment system 1100 for encoding audio signal 1124. System 1100 includes low band encoder 1104 that encode an original low band signal 1120 using a closed loop analysis-by-synthesis approach to obtain coded low band signal 1114. The system also includes high band encoder 1106 that encodes original high band signal 1122 using an open loop energy matching approach to obtain coded high band energy envelopes 1116. Energy comparison block 1108 compare an energy of coded low band signal 1114 with an energy of corresponding original low band signal 1120 for a subframe, and generates indication flag 1112 to indicate whether an energy envelope perceptual correction is needed for the subframe based on comparing the energy. Interface block 1118 outputs a bitstream that includes coded low band signal 1114, coded high band energy envelopes 1116, and indication flag 1112.

In an embodiment, filter bank analysis block 1102 converts audio signal into original low band signal 1120, and original high band signal 1122. In some embodiments, filter bank analysis block 1102. In some embodiments, coded low band signal 1114, includes low band frequency coefficients. In some embodiments, filter bank analysis block 1102 produces original low band signal 1120, and original high band signal 1122 in the frequency domain having frequency coefficients. In other embodiments original low band signal 1120 and original high band signal 1122 are represented in the time domain.

In an embodiment, energy comparison block 1108 determine if an average energy of the coded low band signal 1114 is lower than an average energy of the corresponding original low band signal 1120 within a subframe. If so, the indication flag 1112 is set to a true value. Alternatively, the indication flag 1112 is set to a true value if energy comparison block 1108 determined that a maximum energy of the coded low band signal 1114 is lower than a maximum energy of the corresponding original low band signal 1120 within the subframe.

Figure 12:
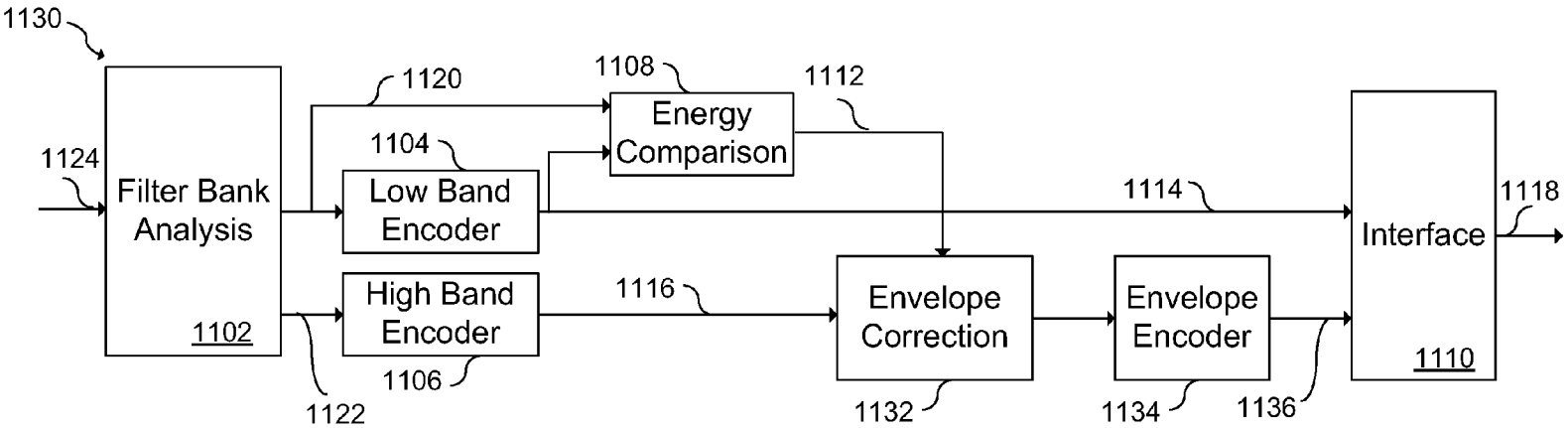
FIG. 12 illustrates an, block diagram of a further embodiment encoder.

FIG. 12 illustrates embodiment system 1130 for encoding audio signal 1124, which is similar to system 1100 of FIG. 11, with the addition of envelope correction block 1132 and high envelope encoder 1134. Envelope correction block 1132 reduces amplitudes of the high band energy envelopes 1116 if indication flag 1112 is set true, and high band energy envelope encoder 1134 encodes the corrected envelopes after applying the energy envelope perceptual correction at the encoder by using an open loop energy matching to obtain coded high band energy envelopes 1136. In an embodiment, interface block 1110 transmits coded low band signal 1114 and coded high band energy envelopes 1136. In some embodiment, where envelope correction is applied at the encoder, interface block 1110 does not transmit indication flag 1112.

In an embodiment, envelope correction block 1132 reduces the amplitude of the high band energy envelopes 1116 by multiplying a gain factor, which is smaller than 1, with the high band energy envelopes.

Figure 13:
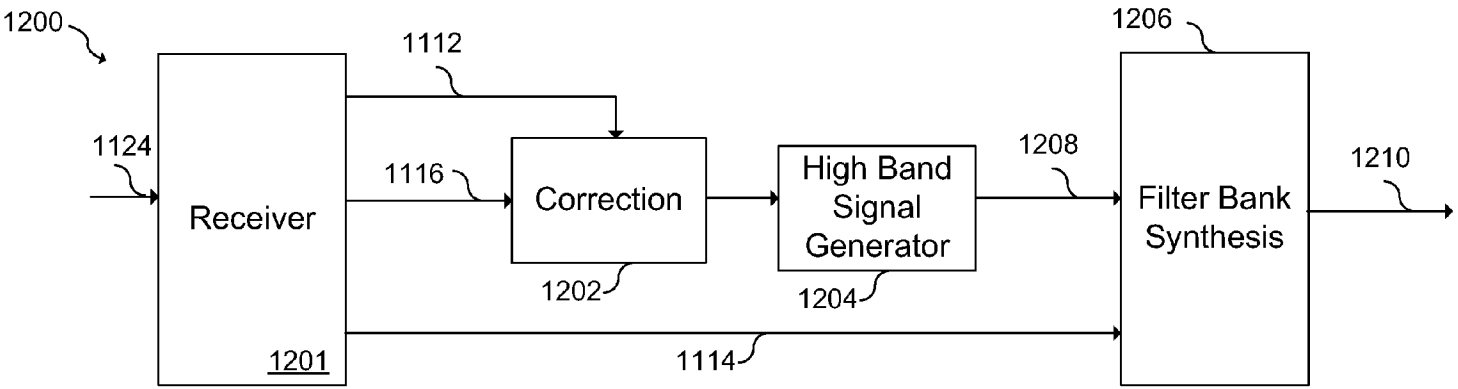
FIG. 13 illustrates a block diagram of an embodiment decoder.

FIG. 13 illustrates system 1200 for decoding encoded audio bitstream 1124. Receiver 1201 receives encoded bitstream 1124 having comprising coded low band signal 1114, coded high band energy envelopes 1116 an indication flag 1112 as described above. Perceptual correction block 1202 reduces amplitudes of coded high band energy envelopes 1116 according to embodiment algorithms described herein to form corrected coded high band energy envelopes if indication flag 1112 is set true. High band signal generator 1204, which is coupled to the perceptual correction block 1202, applies high band energy envelopes to form generated high band signal 1208. Filter bank synthesis block 1206 forms output speech/audio 1210 signal from coded low band signal 1114 and generated high band signal 1208. In an embodiment, perceptual correction block 1202 is configured to reduce the amplitude of coded high band energy envelopes 1116 by multiplying a gain factor, which is smaller than 1, with coded high band energy envelopes 1116. In a further embodiment, the amplitude of coded high band envelopes 1116 is reduced by multiplying a gain factor, which is smaller than 1, with the generated high band signal.

Advantages of embodiments include subjective improvement of received sound quality at low bit rates with low cost.

Although the embodiments and their advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of encoding an audio bitstream at an encoder, the method comprising:

encoding an original low band signal at the encoder by using a closed loop analysis-by-synthesis approach to obtain a coded low band signal;

encoding an original high band signal at the encoder by using an open loop energy matching approach to obtain coded high band energy envelopes;

comparing an energy of the coded low band signal with an energy of a corresponding original low band signal for a subframe;

generating an indication flag that indicates whether an energy envelope perceptual correction is needed for the subframe based on comparing the energy; and electronically transmitting the coded low band signal, the coded high band energy envelopes, and the indication flag.

2. The method of claim 1, wherein:

the original low band signal comprises original low band frequency coefficients;

the original high band signal comprises original high band frequency coefficients; and the coded low band signal comprises coded low band frequency coefficients.

3. The method of claim 2, further comprising using filter-bank analysis to transform an input audio signal into the original low band frequency coefficients and the original high band frequency coefficients.

4. The method of claim 1, wherein generating the indication flag comprises determining if an average energy of the coded low band signal is lower than an average energy of the corresponding original low band signal within the subframe.

5. The method of claim 1, wherein generating the indication flag comprises determining if a maximum energy of the coded low band signal is lower than a maximum energy of the corresponding original low band signal within the subframe.

6. The method of claim 1, further comprising dividing a speech/audio frame into a plurality of subframes.

7. The method of claim 1 wherein the closed loop analysis-by-synthesis approach comprises using Code-Excited Linear Prediction (CELP) techniques.

8. The method of claim 1, wherein the open loop energy matching approach comprises using Bandwidth Extension (BWE) or Spectral Band Replication (SBR) techniques.

9. A method of decoding an encoded audio bitstream at a decoder, the method comprising:

electronically receiving the encoded audio bitstream, the encoded audio bitstream comprising a coded low band signal, coded high band energy envelopes, and an indication flag;

performing an energy envelope perceptual correction by reducing amplitudes of the coded high band energy envelopes if the indication flag is in a true state;

generating a high band signal by applying the coded high band energy envelopes after performing the energy envelope perceptual correction; and forming an output speech/audio signal from the coded low band signal and the generated high band signal.

10. The method of claim 9, wherein:

the coded low band signal, coded high band energy envelopes, and an indication flag are received within a subframe; and reducing the amplitude is performed if the indication flag is in the true state within the subframe.

11. The method of claim 9, wherein:

the coded low band signal comprises coded low band frequency coefficients; and the generated high band signal comprises generated high band frequency coefficients.

12. The method of claim 11, wherein forming the output speech/audio signal comprises using Filter-Bank synthesis to inverse-transform the coded low band frequency coefficients and the generated high band frequency coefficients into the time domain.

13. The method of claim 9, wherein reducing the amplitude of the coded high band energy envelopes comprises multiplying a gain factor, which is smaller than 1, with the coded high band energy envelopes.

14. The method of claim 9, wherein reducing the amplitude of the coded high band energy envelopes comprises multiplying a gain factor, which is smaller than 1, with the generated high band signal.

15. A method of encoding an audio bitstream at an encoder, the method comprising:

encoding an original low band signal at the encoder by using a closed loop analysis-by-synthesis approach to obtain a coded low band signal;

encoding an original high band signal at the encoder by using an open loop energy matching approach to obtain coded high band energy envelopes;

comparing an energy of the coded low band signal with an energy of a corresponding original low band signal;

generating an indication flag that indicates whether an energy envelope perceptual correction is needed based on comparing the energy;

calculating high band energy envelopes of the original high band signal at the encoder;

applying energy envelope perceptual correction by reducing amplitudes of the high band energy envelopes if the indication flag is true;

encoding the high band energy envelopes after applying the energy envelope perceptual correction at the encoder by using an open loop energy matching to obtain coded high band energy envelopes; and electronically transmitting the coded low band signal, and the coded high band energy envelopes.

16. The method of claim 15, wherein:

the original low band signal comprises original low band frequency coefficients;

the original high band signal comprises original high band frequency coefficients; and the coded low band signal comprises coded low band frequency coefficients.

17. The method of claim 16, further comprising using filter-bank analysis to transform an input audio signal into the original low band frequency coefficients and the original high band frequency coefficients.

18. The method of claim 15, wherein generating the indication flag comprises determining if an average energy of the coded low band signal is lower than an average energy of the corresponding original low band signal.

19. The method of claim 15, wherein generating the indication flag comprises determining if a maximum energy of the coded low band signal is lower than a maximum energy of the corresponding original low band signal.

20. The method of claim 15, wherein:

the closed loop analysis-by-synthesis approach comprises using Code-Excited Linear Prediction (CELP) techniques; and the open loop energy matching approach comprises using Bandwidth Extension (BWE) or Spectral Band Replication (SBR) techniques.

21. The method of claim 15, wherein reducing the amplitude of the high band energy envelopes comprises multiplying a gain factor, which is smaller than 1, with the high band energy envelopes.

22. A system for encoding an audio signal, the system comprising:

a low band encoder configured to encode an original low band signal using a closed loop analysis-by-synthesis approach to obtain a coded low band signal;

a high band encoder configured to encode an original high band signal using an open loop energy matching approach to obtain coded high band energy envelopes;

an energy comparison block configured to compare an energy of the coded low band signal with an energy of a corresponding original low band signal for a subframe, and generate an indication flag to indicate whether an energy envelope perceptual correction is needed for the subframe based on comparing the energy; and an interface block configured to transmit the coded low band signal, the coded high band energy envelopes, and the indication flag.

23. The system of claim 22, wherein:

the original low band signal comprises original low band frequency coefficients;

the original high band signal comprises original high band frequency coefficients;

the coded low band signal comprises coded low band frequency coefficients; and the system further comprises a filter bank analysis block configured to transform an input audio signal into the original low band frequency coefficients and the original high band frequency coefficients.

24. The system of claim 22, wherein the energy comparison block is configured to determine if an average energy of the coded low band signal is lower than an average energy of the corresponding original low band signal within the subframe.

25. The system of claim 22, wherein the energy comparison block is configured to determine if a maximum energy of the coded low band signal is lower than a maximum energy of the corresponding original low band signal within the subframe.

26. A system for encoding an audio signal, the system comprising:

a low band encoder configured to encode an original low band signal using a closed loop analysis-by-synthesis approach to obtain a coded low band signal;

a high band encoder configured to encode an original high band signal using an open loop energy matching approach to obtain coded high band energy envelopes;

an energy comparison block configured to compare an energy of the coded low band signal with an energy of a corresponding original low band signal for a subframe, and generate an indication flag that indicates whether an energy envelope perceptual correction is needed for the subframe based on comparing the energy;

a correction block configured to reduce amplitudes of the high band energy envelopes if the indication flag is true;

a high band energy envelope encoder configured to encode the high band energy envelopes after applying the energy envelope perceptual correction at the encoder by using an open loop energy matching to obtain coded high band energy envelopes; and an interface block configured to transmit the coded low band signal, and the coded high band energy envelopes.

27. The system of claim 26, wherein the energy comparison block is configured to determine if an average energy of the coded low band signal is lower than an average energy of the corresponding original low band signal within the subframe.

28. The system of claim 26, wherein the energy comparison block is configured to determine if a maximum energy of the coded low band signal is lower than a maximum energy of the corresponding original low band signal within the subframe.

29. The system of claim 26, wherein the correction block is configured to reduce the amplitude of the high band energy envelopes by multiplying a gain factor, which is smaller than 1, with the high band energy envelopes.

30. A system for decoding an encoded audio bitstream, the system comprising:

a receiver for receiving an encoded bitstream comprising a coded low band signal, coded high band energy envelopes, and an indication flag;

a perceptual correction block configured to reduce amplitudes of the coded high band energy envelopes to form corrected coded high band energy envelopes if the indication flag is in a true state;

a high band signal generator coupled to the perceptual correction block, the high band signal generator configured to apply the high band energy envelopes to form a generated high band signal; and a filter bank synthesis block configured to form an output speech/audio signal from the coded low band signal and the generated high band signal.

31. The system of claim 30, wherein the perceptual correction block is configured to reduce the amplitude of the coded high band energy envelopes by multiplying a gain factor, which is smaller than 1, with the coded high band energy envelopes.

32. The system of claim 30, wherein the perceptual correction block is configured to reduce the amplitude of the coded high band energy envelopes by multiplying a gain factor, which is smaller than 1, with the generated high band signal.

33. A non-transitory computer readable medium has an executable program stored thereon, wherein the program instructs a processor to perform the steps of:

encoding an original low band signal using a closed loop analysis-by-synthesis approach to obtain a coded low band signal;

encoding an original high band signal using an open loop energy matching approach to obtain coded high band energy envelopes;

comparing an energy of the coded low band signal with an energy of a corresponding original low band signal for a subframe;

generating an indication flag that indicates whether an energy envelope perceptual correction is needed for the subframe based on comparing the energy; and transmitting the coded low band signal, the coded high band energy envelopes, and the indication flag.

34. A non-transitory computer readable medium has an executable program stored thereon, wherein the program instructs a processor to perform the steps of:

encoding an original low band signal using a closed loop analysis-by-synthesis approach to obtain a coded low band signal;

encoding an original high band signal using an open loop energy matching approach to obtain coded high band energy envelopes;

comparing an energy of the coded low band signal with an energy of a corresponding original low band signal for a subframe;

generating an indication flag that indicates whether an energy envelope perceptual correction is needed for the subframe based on comparing the energy;

calculating high band energy envelopes of the original high band signal at the encoder;

applying energy envelope perceptual correction by reducing amplitudes of the high band energy envelopes if the indication flag is true;

encoding the high band energy envelopes after applying the energy envelope perceptual correction at the encoder by using an open loop energy matching to obtain coded high band energy envelopes; and transmitting the coded low band signal, and the coded high band energy envelopes.

* * * * *